United States Patent [19]

Ezawa

[11] Patent Number: 4,539,885

[45] Date of Patent: Sep. 10, 1985

[54] ELECTRONIC MUSICAL INSTRUMENT

[75] Inventor: Sadaaki Ezawa, Iwata, Japan

[73] Assignee: Kabushiki Kaisha Kawai Gakki Seisakusho, Japan

[21] Appl. No.: 603,116

[22] Filed: Apr. 24, 1984

Related U.S. Application Data

[63] Continuation of Ser. No. 372,052, Apr. 26, 1982, abandoned.

[30] Foreign Application Priority Data

Apr. 30, 1981 [JP] Japan ..... 56-65711

[51] Int. Cl.[3] ..... G10H 1/04; G10H 7/00

[52] U.S. Cl. ..... 84/1.25; 84/1.24

[58] Field of Search ..... 84/1.24, 1.25

[56] References Cited

U.S. PATENT DOCUMENTS

| | | | |
|---|---|---|---|
| 3,929,053 | 12/1975 | Deutsch | 84/1.24 |
| 3,951,030 | 4/1976 | Deutsch | 84/1.25 |
| 3,978,755 | 9/1976 | Woron | 84/1.24 |
| 3,979,996 | 9/1976 | Tomisawa et al. | 84/1.25 |
| 4,122,743 | 10/1978 | Tomisawa et al. | 84/1.24 |
| 4,152,966 | 5/1979 | Deutsch | 84/1.24 |
| 4,189,972 | 2/1980 | Yamada et al. | 84/1.25 |
| 4,198,892 | 4/1980 | Gross | 84/1.25 |
| 4,351,220 | 9/1982 | Yamada et al. | 84/1.24 |
| 4,375,178 | 3/1983 | Whitefield | 84/1.25 |

*Primary Examiner*—Stanley J. Witkowski

*Attorney, Agent, or Firm*—McGlew and Tuttle

[57] ABSTRACT

An electronic musical instrument which employs frequency numbers and is capable of producing a natural and expressive effect such as vibrato or the like with a simple structure. The electronic musical instrument is provided with a frequency number memory for storing a frequency number corresponding to the note of each key and a frequency number for modulation prepared for each key corresponding to frequency modulated data, a frequency modulated data generating units for selectively generating glide data and vibrato data, and an key assignor for generating key depression information and keyboard information. The key depression information being used to address a high-order address of the frequency number memory and the low-order address of the frequency number memory by being addressed frequency modulated data available from the frequency modulated data generating units.

2 Claims, 5 Drawing Figures

L6
A0
A1
A2
A3
A4
EOR
150
151
152
153
154
155
156
OR
L3
L4
L7
170
OR
NOT
L2
L5
A'0
A'1
A'2
A'3
A'4
tg
t'n
R'(t'n)
A'4A'3A'2A'1A'0
x:"1"/"0"

ELECTRONIC MUSICAL INSTRUMENT

This is a continuation of application Ser. No. 372,052 filed Apr. 26, 1982, and now abandoned.

BACKGROUND OF THE INVENTION

1. Field of the Invention

The present invention relates to an electronic musical instrument which employs a frequency number corresponding to a fundamental frequency of each key and is capable of producing a natural and expressive effect such as vibrato or the like with a simple structure.

2. Description of the Prior Art

Usually, a violin, viola, cello or like instrument is played with vibrato. In relation to the playing speed, what is called a delayed vibrato technique is used which starts with slight vibrato of low speed and gradually develops fast and deep vibrato. Electronic musical instruments for producing such an effect are known from Japanese Laid-Open Patent Gazettes Nos. 132327/78 and 115127/79. According to these prior art examples, in an electronic musical instrument which employs frequency numbers, a fractional frequency number is obtained from a frequency number based on produced frequency modulated data and it is added to or subtracted from its original frequency number, to obtain a frequency modulated number corresponding to the produced frequency modulated data. Accordingly, the prior art electronic musical instruments require a multiplier for obtaining the fractional frequency number, a complementor for converting the multiplier output into a complement and an adder for adding the complementor output and the original frequency number. The conventional circuit arrangement involves many adders, and hence it is complex. The present invention is intended to produce the same effect as described above by using highly reliable, large-capacity and small fixed memories (ROMs) in place of the aforementioned multipliers and adders.

SUMMARY OF THE INVENTION

It is therefore an object of the present invention to provide an electronic musical instrument which employs a frequency number and is capable of producing a natural and expressive effect such as vibrato or the like with a simple structure.

Briefly stated, the electronic musical instrument of the present invention is provided with a frequency number memory for storing a frequency number corresponding to the note of each key and a frequency number for modulation prepared for each note corresponding to frequency modulated data, frequency modulated data generating means for selectively generating glide data and vibrato data, a key assignor for generating key depression information and keyboard information, and means for addressing the high-order address of the frequency number memory by the key depression information and the low-order address of the memory by frequency modulated data available from the frequency modulated data generating means.

DESCRIPTION OF THE PREFERRED EMBODIMENTS

Figure 1:
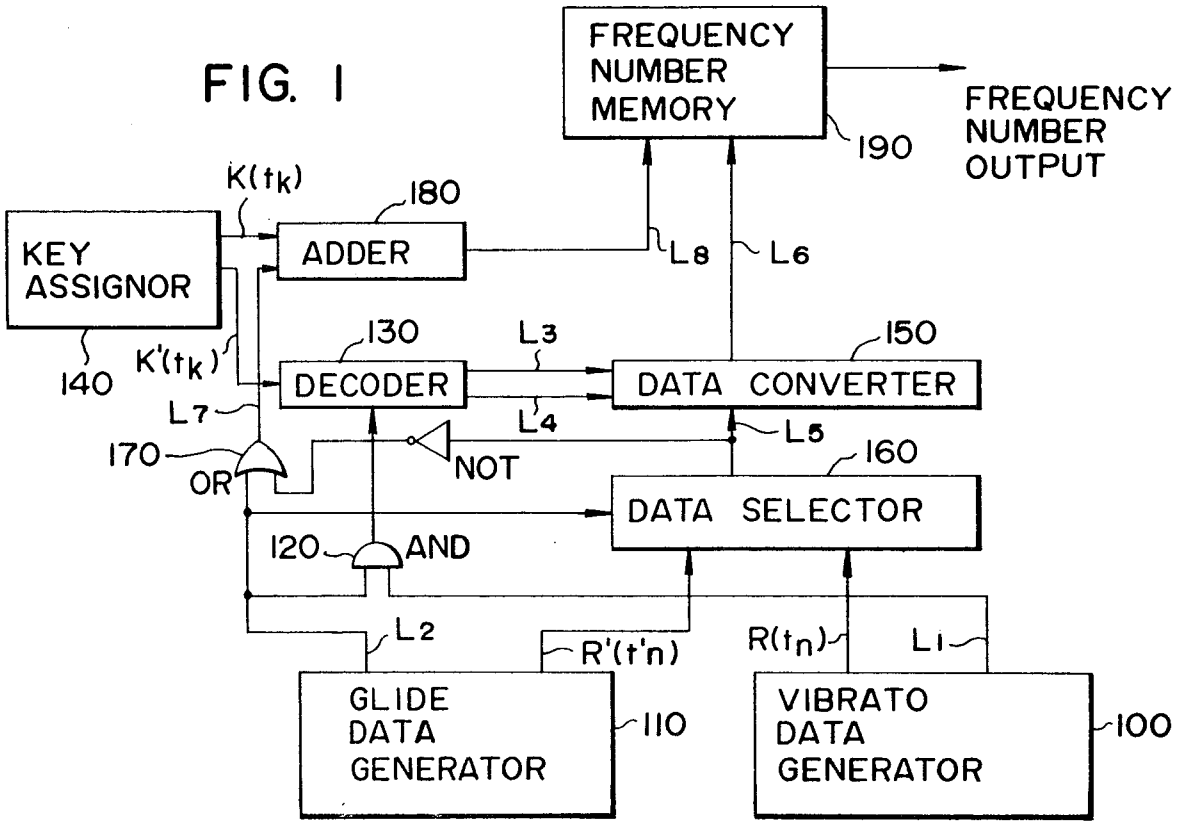
FIG. 1 is a block diagram of an embodiment of the present invention.
Figure 2A:
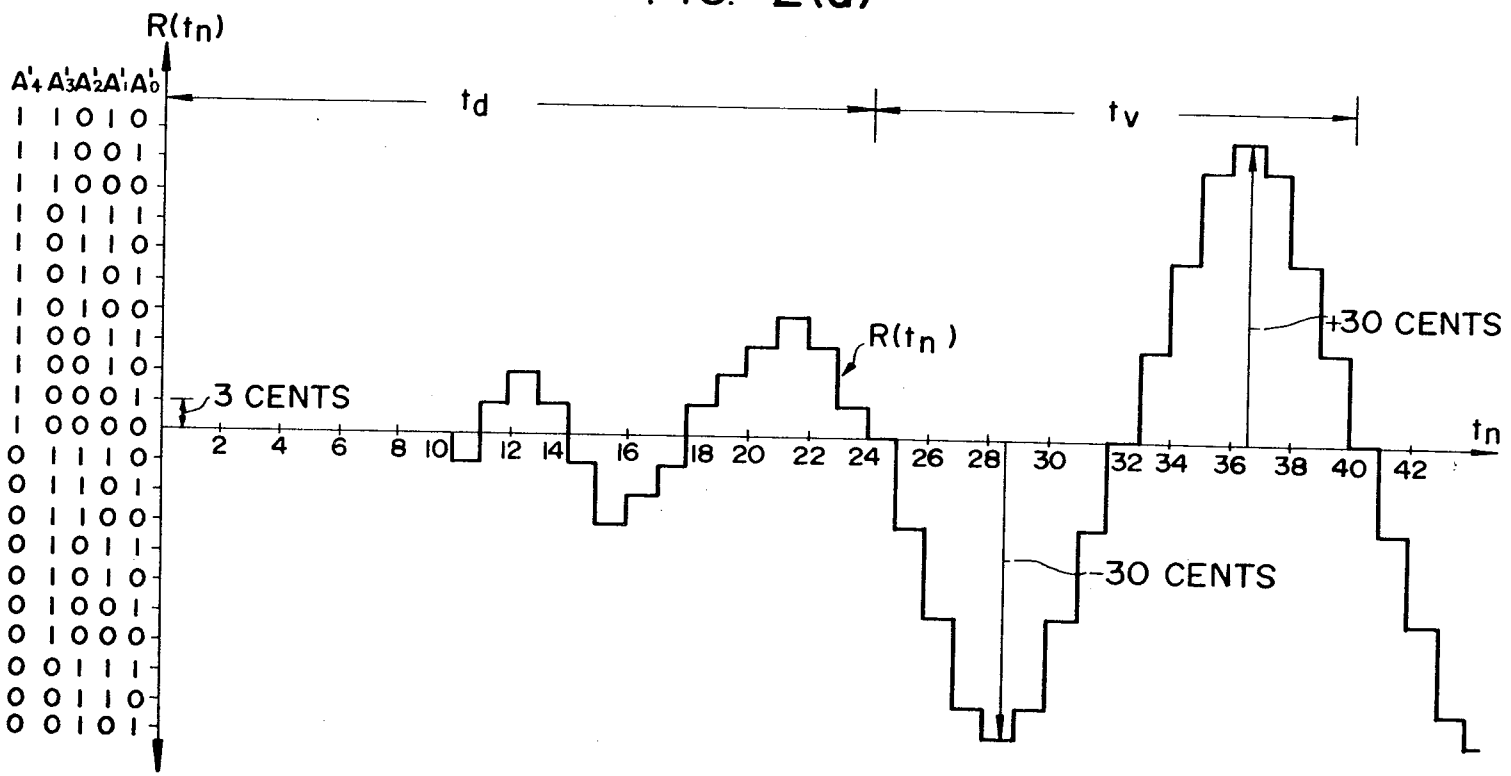
FIGS. 2(*a*) and (*b*) are graphs which are explanatory of examples of vibrato and glide data waveshapes in the present invention.

FIG. 1 is a block diagram illustraing an arrangement of one embodiment of the present invention. A frequency modulated data output $R(t_n)$ of a vibrato data generator 100 in FIG. 1 is shown in FIG. 2(*a*). A vibrato waveshape is shown with time $t_n$ plotted on the adscissa and the frequency modulated data output $R(t_n)$ on the ordinate.

In FIG. 2(*a*), a period $t_d$ from the start of playing to a moment $t_{24}$ is a delayed vibrato period and a period $t_v$ from the moment $t_{24}$ to $t_{40}$ is a vibrato period. After the moment $t_{40}$ the period $t_v$ is repeated. If the delayed vibrato is unnecessary, the period $t_d$ may be omitted. The output on a line L1 from the vibrator data generator 100 in FIG. 1 indicates whether vibrato is produced and it carries a "0" or "1" depending upon whether the vibrato data generator 100 is in operation. Let it be assumed that when no vibrato effect is being produced, the frequency modulated data output $R(t_n)$ is an address $A'_4A'_3A'_2A'_1A'_0$ (10000) indicating a standard pitch. A frequency modulated data output $R'(t'_n)$ from a glide data generator 110 is shown in FIG. 2(*b*). An output L2 from the glide data generator 110 in FIG. 1 indicates whether glide is being carried out. The output L2 is "0" when the glide effect is produced (a period $t_g$), and "1" when no glide effect is produced (periods other than $t_g$). The vibrato data generator 100 and the glide data generator 110 are not directly related to the present invention, and hence no detailed description will be given thereof. The frequency modulated data $R(t_n)$ and $R'(t'_n)$ may also be stored in separately provided ROMs and read out therefrom as required, or may also be generated by logical circuits as in the aforementioned prior art electronic musical instruments. For instance, the address bits A'4, A'3 and A'2 of the frequency modulated data $R'(t'_n)$ are equal to inverted bits of two low-order bits (corresponding to $A'_2$ and $A'_3$) of the output of the up-down operation of a seven-step counter.

An AND gate 120 turns ON a decoder 130 in the case where neither vibrato nor glide are carried out. Upon depression of a key on a keyboard (not shown), a key assignor 140 delivers key depression information $K(t_k)$ which is coded information of the depressed key coded as shown in Table and, at the same time, the key assignor 140 delivers keyboard information $K'(t_k)$ which is coded information indicating the keyboard, i.e. an upper, lower or pedal keyboard, to which the key depression information $(Kt_k)$ belongs. The keyboard information $K'(t_k)$ is provided via the decoder 130 to a data converter 150 to control it. That is to say, if the keyborad information $K'(t_k)$ is a code indicating a lower keyboard, then an output L3 from the decoder 130 is "1" and an output L4 is "0", and in the case of a pedal keyboard, the outputs L3 and L4 are "0" and "1", respectively, and in the case of an upper keyboard, the outputs L3 and L4 are both "0". In the case where vibrato or glide is carried out, the decoder 130 is turned OFF and the keyboard information $K'(t_k)$ is not decoded and the outputs L3 and L4 are both "0", indicating the upper keyboard.

Figures 2B, 3:
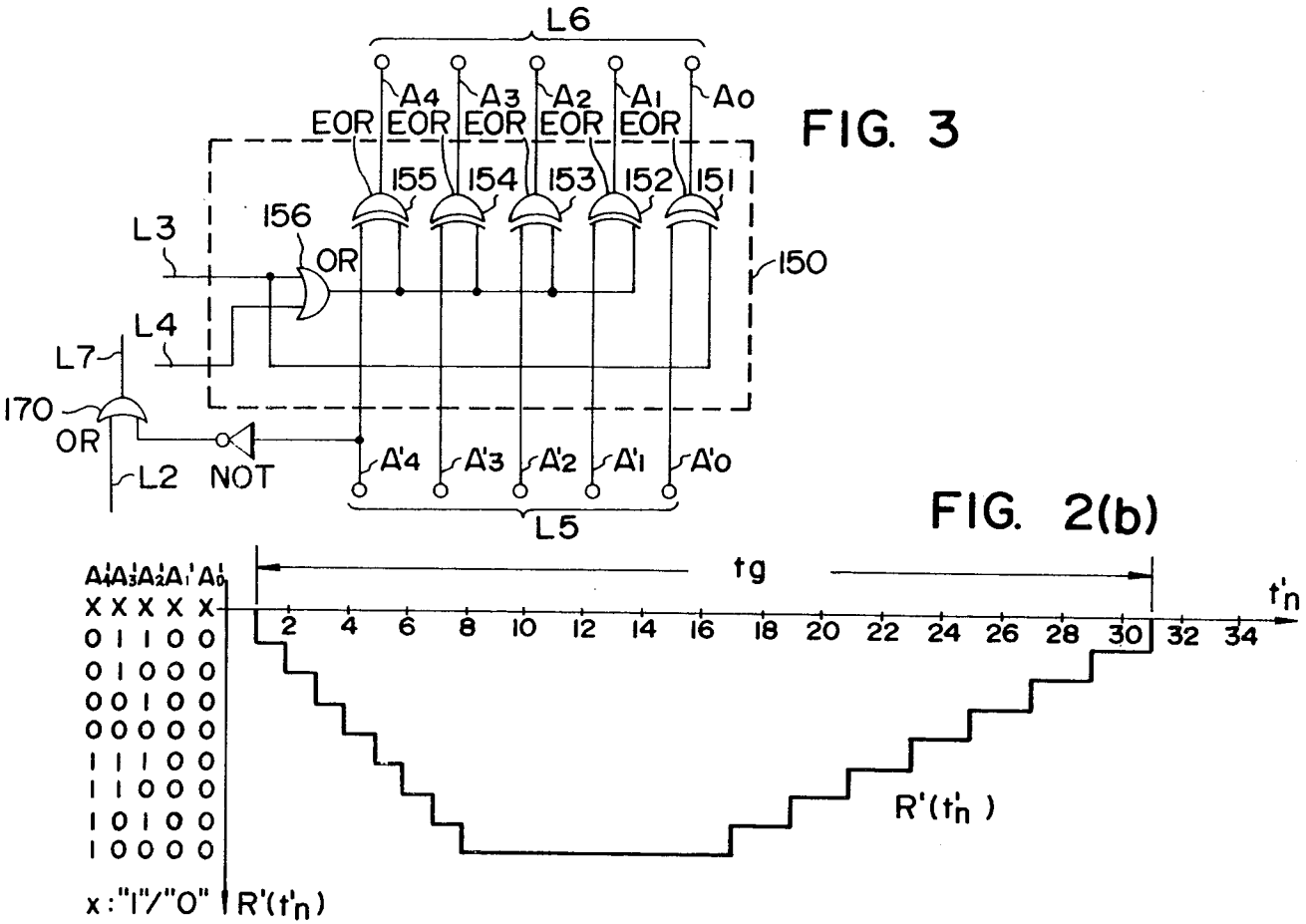
FIG. 3 is a block diagram illustrating a specific example of the circuit arrangement of a data converter used in the embodiment of FIG. 1.

FIG. 3 illustrates a specific example of the circuit arrangement of the data converter 150. In FIG. 3, an output L5 ($A'_4$ to $A'_0$) from a data selector 160 is applied to one input of each of exclusive OR circuits (EOR) 151 to 155, the output L3 from the decoder 130 is provided directly to the other input of the exclusive OR circuit 151, and the decoder outputs L3 and L4 are supplied via an OR circuit 156 to the other inputs of the exclusive OR circuits 152 to 155, thus obtaining an output L6 ($A_4$ to $A_0$). As a result of this, in the case of the upper keyboard, an address $A'_4A'_3A'_2A'_1A'_0$ which constitutes the output L5 from the data selector 160 is provided, in the case of the lower keyboard, an address $\overline{A'_4}\overline{A'_3}\overline{A'_2}\overline{A'_1}\overline{A'_0}$ is provided and in the case of the pedal keyboard, an address $\overline{A'_4}\overline{A'_3}\overline{A'_2}\overline{A'_1}A'_0$ is provided, producing an address $A_4A_3A_2A_1A_0$. When the output L2 from the glide data generator 110 is "0", glide is being carried out, so that the data selector 160 selects the frequency modulated data $R'(t'_n)$. When the output L2 is "1", the data selector 160 selects the frequency modulated data $R(t_n)$. An OR gate 170 is supplied with a NOT output of the L5 output $A'_4$ and the L2 output and sends out an output L7 to an adder 180.

Next, a description will be given of addressing of a frequency number memory in the case of the outputs from the vibrato data generator 100 and the glide data generator 110 being changed.

First, when neither vibrato nor glide are carried out, as the output L2 from the glide data generator 110 is "1", the output L7 from the OR gate 170 is "1" and key depression information $K(t_k)+1$ is sent out to an output L8 of the adder 180. The information $K(t_k)+1$ on the line L8 is connected to $A_5(=2^5)A_{10}(=2^{10})$ which are high order bits of an address made up of 11 bits $A_0$ to $A_{10}$ of the frequency number memory 190 formed as shown in Tables 2(a) and (b). The bits $A_5$ to $A_{10}$ will hereinafter be referred to as the high-order address. To the output L5 is sent out the frequency modulated data $R(t_n)$ but, as the vibrato effect is OFF, the data $R(t_n)$ is an address $A'_4$ to $A'_0$ (10000) indicating the standard pitch as is evident from FIG. 2(*a*). The data $R(t_n)$ is converted by the data converter 150, which is controlled by the keyboard information $K'(t_k)$ into $A_4$ to $A_0$ (10000) in the case of the upper keyboard, $A_4$ to $A_0$ (01111) in the case of the lower keyboard and $A_4$ to $A_0$ (01110) in the case of the pedal keyboard. The converted output is provided to the output L6. $A_4$ to $A_0$ (10000) in the case of the upper keyboard, (01111) in the case of the lower keyboard and $A_4$ to $A_0$ (01110) in the case of the pedal keyboard. The output on the line L6 is connected to $A_0(-2^0)$ $A_4(-2^4)$ which are low-order bits of the address made up of 11 bits $A_0$ to $A_{10}$ of the frequency number memory 190 formed as shown in Tables 2(a) and (b). The bits $A_0$ to $A_4$ will hereinafter be referred to as the low-order address. Now, letting $[\ldots]_H$ and $[\ldots]_L$ represent the high-order address and the low-order address, respectively, $[K(t_k)+1]_H$ $[10000]_L$ $[K(t_k)+1]_H[01111]_L$ and $[K(t_k))+1]_H[01110]_L$ are addresses of the frequency number memory 190 for the upper, lower and pedal keyboards. If the data $K(t_k)$ takes such a coding system as shown in Table 1, the stored contents of the frequency number memory 190 are such as shown in Tables 2(a) and (b).

TABLE 1

| NOTE | $K(t_k)$ $A_{10}$ | $A_9$ | $A_8$ | $A_7$ | $A_6$ | $A_5$ |
|---|---|---|---|---|---|---|
| C 2 | 0 | 0 | 0 | 0 | 0 | 0 |
| C#2 | 0 | 0 | 0 | 0 | 0 | 1 |
| D 2 | 0 | 0 | 0 | 0 | 1 | 0 |
| D#2 | 0 | 0 | 0 | 0 | 1 | 1 |
| E 2 | 0 | 0 | 0 | 1 | 0 | 0 |
| F 2 | 0 | 0 | 0 | 1 | 0 | 1 |
| F#2 | 0 | 0 | 0 | 1 | 1 | 0 |
| G 2 | 0 | 0 | 0 | 1 | 1 | 1 |
| G#2 | 0 | 0 | 1 | 0 | 0 | 0 |
| A 2 | 0 | 0 | 1 | 0 | 0 | 1 |
| A#2 | 0 | 0 | 1 | 0 | 1 | 0 |
| B 2 | 0 | 0 | 1 | 0 | 1 | 1 |
| C 3 | 0 | 0 | 1 | 1 | 0 | 0 |
| C#3 | 0 | 0 | 1 | 1 | 0 | 1 |
| . | | | | . | | |
| . | | | | . | | |
| . | | | | . | | |
| C 7 | 1 | 1 | 1 | 1 | 0 | 0 |

TABLE 2

| MOMENT | ADDRESS HIGH-ORDER ADDRESS $A_{10}$ | $A_9$ | $A_8$ | $A_7$ | $A_6$ | $A_5$ | LOW-ORDER ADDRESS $A_4$ | $A_3$ | $A_2$ | $A_1$ | $A_0$ | STORED FREQUENCY NUMBERS | |
|---|---|---|---|---|---|---|---|---|---|---|---|---|---|
| 0 | 0 | 0 | 0 | 0 | 0 | 0 | 0 | 0 | 0 | 0 | 0 | | |
| 1 | | | | | | | | | | | 1 | | |
| 2 | | | | | | | | | | 1 | | | |
| 3 | | | | | | | | | | 1 | 1 | | |
| 4 | | | | | | | | | 1 | | | | |
| 5 | | | | | | | | | 1 | | 1 | B1-R($t_{28}$) | |
| 6 | | | | | | | | | 1 | 1 | | B1-R($t_{27}$),R($t_{29}$) | |
| 7 | | | | | | | | | 1 | 1 | 1 | | |
| 8 | | | | | | | | 1 | | | | | |
| 9 | | | | | | | | 1 | | | 1 | B1-R($t_{26}$),R($t_{30}$) | |
| 10 | | | | | | | | 1 | | 1 | | | |
| 11 | | | | | | | | 1 | | 1 | 1 | | |
| 12 | | | | | | | | 1 | 1 | | | B1-R($t_{15}$),R($t_{25}$),R($t_{31}$) | |
| 13 | | | | | | | | 1 | 1 | | 1 | B1-R($t_{16}$) | |
| 14 | | | | | | | | 1 | 1 | 1 | | B1-R($t_{1O}$),R($t_{14}$),R($t_{17}$),PEDAL | |
| 15 | | | | | | | | 1 | 1 | 1 | 1 | B1-LOWER | |
| 16 | | | | | | | 1 | | | | | B1-UPPER | C2-R'($t'_8$) |
| 17 | | | | | | | 1 | | | | 1 | B1-R($t_{11}$),R($t_{13}$),R($t_{18}$),R($t_{23}$) | |
| 18 | | | | | | | 1 | | | 1 | | B1-R($t_{12}$),R($t_{19}$) | |
| 19 | | | | | | | 1 | | | 1 | 1 | B1-R($t_{20}$),R($t_{22}$),R($t_{33}$),R($t_{39}$) | |
| 20 | | | | | | | 1 | | 1 | | | B1-R($t_{21}$) | C2-R'($t'_7$),R'($t'_{17}$) |
| 21 | | | | | | | 1 | | 1 | | 1 | | |
| 22 | | | | | | | 1 | | 1 | 1 | | B1-R($t_{34}$),R($t_{38}$) | |
| 23 | | | | | | | 1 | | 1 | 1 | 1 | | |
| 24 | | | | | | | 1 | 1 | | | | | C2-R'($t'_6$),R'($t'_{19}$) |

TABLE 2-continued

| | ADDRESS | | | | | | | | | | | | |
|---|---|---|---|---|---|---|---|---|---|---|---|---|---|
| | HIGH-ORDER ADDRESS | | | | | | LOW-ORDER ADDRESS | | | | | | |
| MOMENT | $A_{10}$ | $A_9$ | $A_8$ | $A_7$ | $A_6$ | $A_5$ | $A_4$ | $A_3$ | $A_2$ | $A_1$ | $A_0$ | STORED FREQUENCY NUMBERS | |
| 25 | | | | | | | 1 | 1 | | | 1 | B1-R($t_{35}$),R($t_{37}$) | |
| 26 | | | | | | | 1 | 1 | | 1 | | B1-R($t_{36}$) | |
| 27 | | | | | | | 1 | 1 | | 1 | 1 | | |
| 28 | | | | | | | 1 | 1 | 1 | | | | C2-R'($t'_5$),R'($t'_{21}$) |
| 29 | | | | | | | 1 | 1 | 1 | | 1 | | |
| 30 | | | | | | | 1 | 1 | 1 | 1 | | | |
| 31 | | | | | | | 1 | 1 | 1 | 1 | 1 | | |
| 32 | | | | | | 1 | | | | | | | C2-R'($t'_4$),R'($t'_{23}$) |
| 33 | | | | | | 1 | | | | | 1 | | |
| 34 | | | | | | 1 | | | | 1 | | | |
| 35 | | | | | | 1 | | | | 1 | 1 | | |
| 36 | | | | | | 1 | | | 1 | | | | C2-R'($t'_3$),R'($t'_{25}$) |
| 37 | | | | | | 1 | | | 1 | | 1 | C2-R($t_{28}$) | |
| 38 | | | | | | 1 | | | 1 | 1 | | C2-R($t_{27}$),R($t_{29}$) | |
| 39 | | | | | | 1 | | | 1 | 1 | 1 | | |
| 40 | | | | | | 1 | | 1 | | | | | C2-R'($t'_2$),R'($t'_{27}$) |
| 41 | | | | | | 1 | | 1 | | | 1 | C2-R($t_{26}$),R($t_{30}$) | |
| 42 | | | | | | 1 | | 1 | | 1 | | | |
| 43 | | | | | | 1 | | 1 | | 1 | 1 | | |
| 44 | | | | | | 1 | | 1 | 1 | | | C2-R($t_{15}$),R($t_{25}$),R($t_{31}$) | C2-R'($t'_1$),R'($t'_{29}$) |
| 45 | | | | | | 1 | | 1 | 1 | | 1 | C2-R($t_{16}$) | |
| 46 | | | | | | 1 | | 1 | 1 | 1 | | C2-R($t_{10}$),R($t_{14}$),R($t_{17}$),PEDAL | |
| 47 | | | | | | 1 | | 1 | 1 | 1 | 1 | C2-LOWER | |
| 48 | | | | | | 1 | 1 | | | | | C2-UPPER | C#2-R'$_8$) |
| 49 | | | | | | 1 | 1 | | | | 1 | C2-R($t_{11}$),R($t_{13}$),R($t_{18}$),R($t_{23}$) | |
| 50 | | | | | | 1 | 1 | | | 1 | | C2-R($t_{12}$),R($t_{19}$) | |
| 51 | | | | | | 1 | 1 | | | 1 | 1 | C2-R($t_{20}$),R($t_{22}$),R($t_{33}$),R($t_{39}$) | |
| 52 | | | | | | 1 | 1 | | 1 | | | C2-R($t_{21}$) | C#2-R'($t'_7$),R'($t'_{17}$) |
| 53 | | | | | | 1 | 1 | | 1 | | 1 | | |
| 54 | | | | | | 1 | 1 | | 1 | 1 | | C2-R($t_{34}$),R($t_{38}$) | |
| 55 | | | | | | 1 | 1 | | 1 | 1 | 1 | | |
| 56 | | | | | | 1 | 1 | 1 | | | | | C#2-R'($t'_6$),R'($t'_{19}$) |
| 57 | | | | | | 1 | 1 | 1 | | | 1 | C2-R($t_{35}$),R($t_{37}$) | |
| 58 | | | | | | 1 | 1 | 1 | | 1 | | C2-R($t_{36}$) | |
| 59 | | | | | | 1 | 1 | 1 | | 1 | 1 | | |
| 60 | | | | | | 1 | 1 | 1 | 1 | | | | C#2-R'($t'_5$),R'($t'_{21}$) |
| 61 | | | | | | 1 | 1 | 1 | 1 | | 1 | | |
| 62 | | | | | | 1 | 1 | 1 | 1 | 1 | | | |
| 63 | | | | | | 1 | 1 | 1 | 1 | 1 | 1 | | |
| 64 | | | | | 1 | | | | | | | | C#2-R'($t'_4$),R'($t'_{23}$) |
| 65 | | | | | 1 | | | | | | 1 | | |
| 66 | | | | | 1 | | | | | 1 | | | |
| 67 | | | | | 1 | | | | | 1 | 1 | | |
| 68 | | | | | 1 | | | | 1 | | | | C#2-R'($t'_3$),R'($t'_{25}$) |
| 69 | | | | | 1 | | | | 1 | | 1 | C#2 R($t_{28}$) | |
| 70 | | | | | 1 | | | | 1 | 1 | | C#2-R($t_{27}$),R($t_{29}$) | |
| 71 | | | | | 1 | | | | 1 | 1 | 1 | | |
| . | | | | | | | | | | | | . | . |
| . | | | | | | | | | | | | . | . |
| . | | | | | | | | | | | | . | . |

*All blanks of address are "0".

In general, it is preferred that the upper and lower keyboards have an interval difference of about 1.5 cents relative to each other. Accordingly, the frequency number stored in $[K(t_k)+1]_H[01111]_L$ is about 1.5 cents lower than the frequency number stored in $[K(t_k)+1]_H[10000]_L$, and the frequency number stored in $[K(t_k)+1]_H[01110]_L$ is about 3 cents lower than the frequency number stored in $[K(t_k)+1]_H[10000]_L$.

Next, in the case where the vibrato effect is ON and the glide effect OFF, as the output L2 from the slide data generator 110 is "1", the output L7 is "1" and the adder 180 provides the data $K(t_k)+1$ at its output L8, which is used as the high-order address of the frequency number memory 190. Further, since the output L1 from the vibrato data generator 100 becomes "0", the decoder 130 is turned off and the data converter 150 carries out processing for the upper keyboard. As the output L2 from the glide data generator 110 is "1", the data selector 160 derives the frequency modulated data $R(t_n)$ at the output L5, which data is sent out as it is to the output L6 as described previously, providing an address $[K(t_k)+1]_H[R(t_n)]_L$.

If the ordinate in FIG. 2(*a*) is graduated by steps of three cents, the vibrator effect has a suitable depth of ±30 cents. Consequently, each address of the frequency number memory 190 designated by $[K(t_k)+1]_H[R(t_n)]_L$ is set by steps of three cents. In other words, the frequency numbers are set so that, for instance, in the case of a note C2, 48th, 46th, 45th, 44th, 43rd, 42nd, 41st, 40th, 39th, 38th and 37th moment become lower by steps of three cents and 48th, 49th, 50th, 51st, 52nd, 53rd, 54th, 55th, 56th, 57th and 58th moment become higher by steps of three cents.

On the other hand, a difference between $[K(t_k)+1]_H[10000]_L$ and $[K(t_k)]_H[10000]_L$ is a semitone interval, i.e. 100 cents, and if $[K(t_k)+1]_H[01111]_L$ is omitted, the number of frequency numbers about a semitone internal is 31 and 100/31=3.2258 cents.

Therefore, frequency numbers equally spaced apart may also be set. In this case, the depth of vibrato is ±32.258 cents.

Next, when the glide data generator 110 is in operation, as the glide data generator output L2 is "0", $\overline{A'}_4$ is provided at the output L7, so that the output L8 from the adder 180 becomes $K(t_k)+\overline{A'}_4$, which is used as the high-order address of the frequency number memory 190. Since the glide data generator output L2 is "0", the decoder 130 is turned off and the data converter 150 carries out processing for the upper keyboard. Moreover, since the glide data output L2 is "0", $R'(t'_n)$ is sent out to the output L5 and is provided as it is to the output L6. Accordingly, assuming the width of variation of the glide is -100 cents, then it is necessary that the addresses of the frequency number memory 190 designated by $[K(t_k)+\overline{A'}_4]_H[R'(t'_n)]_L$ be suitably distributed between $[K(t_k)+1]_H[10000]_L$ and $[K(t_k)]_H[10000]_L$.

If the address $A'_4A'_3A'_2A'_1A'_0$ is set as depicted in FIG. 2(*b*), then the frequency number are distributed as given in Tables 2(a) and (b). Then it is seen that $R'(t'_8)$ which maximizes the variation width is stored in an address lower by a semitone (-100 cents). If the frequency numbers equally spaced apart are set, then the pitch interval between the standard pitch upper and the pitch $R'(t'_1)$ or $R'(t'_{29})$ is $3.2258\times3\approx9.7$ cents and the difference between the pitch $R'(t'_1)$ or $R'(t'_{29})$ and the subsequent ones is $3.2258\times4=12.9$ cents. Similarly, the difference between each pair of successive pitches, $R'(t'_2)$ and $R'(t'_{27})$, $R'(t'_3)$ and $R'(t'_{25})$, . . . is 12.9 cents. The pitch interval between and standard pitch and $R'(t'_8)$ is 100 cents as mentioned above.

Recently, fixed memories (ROMs) have become appreciably cheaper. In the case of the embodiment described above, 32 frequency numbers are sufficient for each of 62 tones from B1 to C7. Therefore, $62\times32=1984$ frequency numbers are needed. Let it be assumed that each frequency number is obtained by reading out two words from an ordinary ROM of one word-eight bit configuration. In this case, $1984\times2$ words are required and 4K word$\times$8 bit ROMs can be used therefore which are available at low cost. These ROMs can be used both for vibrato and glide. This is far more economical than the prior art examples involving many multipliers and adders.

Figure 4:
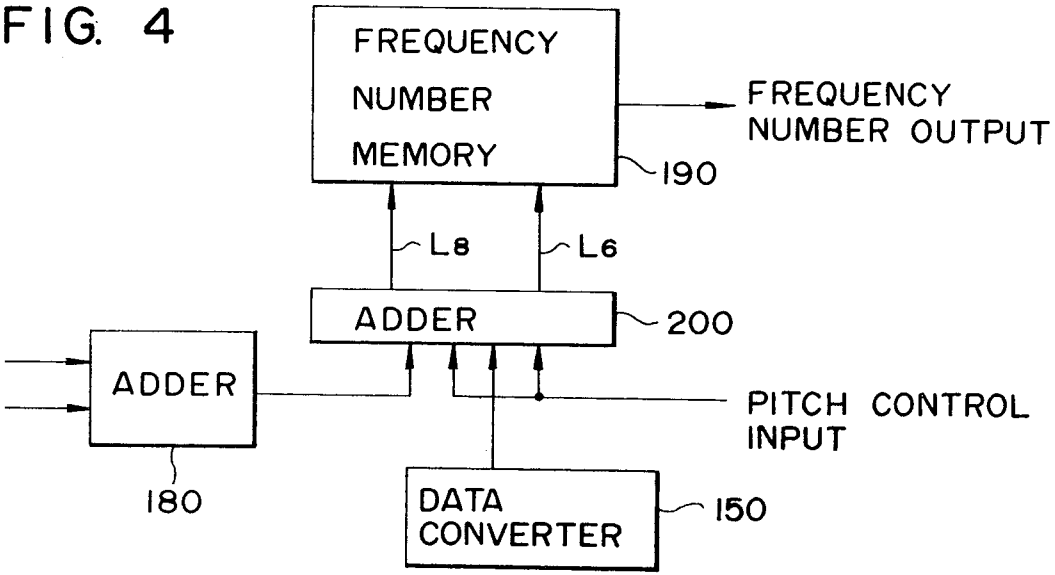
FIG. 4 is a block diagram illustrating a circuit arrangement for adding a pitch control function to the embodiment of FIG. 1.

If the present invention is applied to an electronic musical instrument which does not provide the glide performance, since the frequency number can freely be set for each note name regardless of the glide performance, the vibrato can be set so that its depth may vary according to notes being generated. Furthermore in the event that any difference of interval need not be provided between the upper and the lower keyboard. Of course, it is possible to set in 32 addresses present between $[K(t_k)+1]_H[10000]_L$ and $[K(t_k)]_H[10000]_L$ 32 frequency numbers, each 3.125 cents, into which 100 cents is equally divided. By preparing such a frequency number memory 190, providing an adder 200 on the lines L6 and L8 as shown in FIG. 4 for adding a pitch control input which is date from a pitch control which the player manipulates when he wants to vary the overall pitch, the overall pitch moves in parallel by steps 3.125 cents. Thus, the pitch control function can also be provided. That is the pitch control input is added to the outputs of the data converter 150 and the adder 180 and then provided on the lines L6 and L8. For instance, if the pitch control input is $[00000]_H[00011]_L$, then the low-order address on the line L6 reads out the frequency number at an address where 3 is added to the output of the data converter 150 and, consequently, the overall pitch rises by $3.215\times3$ cents. Since no particular consideration need be paid to the frequency number of $[01111]_L$ for the lower keyboard which is lower than the standard pitch by 1.5 cents the frequency modulated data must be corrected to some extent. For example, in the case of vibrato, $R(t_n)$ has to be modified to be larger on the negative side than on the positive side by 1 and, in this case, the depth of vibrato is 31.25 cents.

As has been described in the foregoing, the electronic musical instrument of the present invention is provided with a frequency number memory for storing both a frequency number corresponding to the note of each key and a frequency number prepared for each key corresponding to modulated data, and means for addressing the frequency number memory using key depression information as its high-order address and frequency modulated data as its low-order address. The electronic musical instrument of the present invention is able to produce a natural and expressive effect such as vibrato or the like with an inexpensive and simple structure.

It will be apparent that many modifications and variations may be effected without departing from the scope of the novel concepts of the present invention.

What is claimed is:

1. An electronic musical instrument having a plurality of keyboards each with keys for playing notes having note names, comprising:

a frequency number memory (190) for storing a frequency number for each note name of each key and a frequency number for modulation for each note name for providing at least one of a vibrato and a glide effect;

frequency modulated data generating means (100, 110) for selectively generating one of glide and vibrato data;

a key assignor (140) for generating key depression information and keyboard information;

the frequency number memory storing therein the frequency number for each note at an address using the key depression information as a function and the frequency number for modulation for each note name at an address using, as functions, frequency modulated data from the frequency modulated data generating means (100, 110) and the key depression information, the frequency number memory additionally storing therein the frequency number corresponding to each note name at an address using the key depression information and the keyboard information as functions;

an address signal for the frequency number memory being divided into a high-order address (L8) by high-order bits and a low-order address (L6) by low-order bits;

means (180, 130) for addressing the high-order address by the key depression information and the low-order address by the frequency modulated data; and a data converter (15) connected in a signal path of the low-order address (16) for converting the output of the frequency modulated data generating means (100, 110) in relation to the keyboard information, the converted output being used as the low-order address of the frequency number memory (190).

2. An electronic musical instrument according to claim 1, wherein an adder (200) is provided in a path of the address signal for the frequency number memory for adding a pitch control signal to the address signal, the output of the adder being used as a new address signal for the frequency number memory.

* * * * *